US011260660B2

(12) United States Patent
Hirai

(10) Patent No.: US 11,260,660 B2
(45) Date of Patent: Mar. 1, 2022

(54) LIQUID DISCHARGE HEAD

(71) Applicant: Brother Kogyo Kabushiki Kaisha, Nagoya (JP)

(72) Inventor: Keita Hirai, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 16/905,447

(22) Filed: Jun. 18, 2020

(65) Prior Publication Data

US 2021/0031515 A1 Feb. 4, 2021

(30) Foreign Application Priority Data

Aug. 1, 2019 (JP) ..... JP2019-141968

(51) Int. Cl.
*B41J 2/14* (2006.01)

(52) U.S. Cl.
CPC ..... *B41J 2/14201* (2013.01)

(58) Field of Classification Search
CPC ..... B41J 2/14201; B41J 2002/14241; B41J 2002/14491; B41J 2/14233
See application file for complete search history.

(56) References Cited

U.S. PATENT DOCUMENTS 8,687,558 B2 4/2014 Jackson et al.
9,579,891 B2 2/2017 Hayashi et al.
2013/0016161 A1 1/2013 Hotta
2015/0273832 A1* 10/2015 Hirai ..... B41J 2/1637 347/71
2016/0207312 A1 7/2016 Hayashi et al.

FOREIGN PATENT DOCUMENTS

JP 2013-018197 A 1/2013
JP 2016-132123 A 7/2016

OTHER PUBLICATIONS

IP.com search (Year: 2021).*

* cited by examiner

*Primary Examiner* — Lisa Solomon
(74) *Attorney, Agent, or Firm* — Banner & Witcoff, Ltd.

(57) ABSTRACT

A liquid discharge head includes: a first substrate including a pressure chamber; and a second substrate. The first substrate has a first surface in which a nozzle communicating with the pressure chamber is opened and a second surface positioned at an opposite side of the first surface and in which a communication hole communicating with the pressure chamber is opened. The second substrate is joined to the second surface of the first substrate and has a channel communicating with the pressure chamber via the communication hole. The pressure chamber has a first end in a first direction and a center portion in the first direction. The communication hole communicates with the first end of the pressure chamber, and the first end of the pressure chamber is greater than the center portion of the pressure chamber in length in a second direction which intersects with the first direction.

11 Claims, 6 Drawing Sheets

LIQUID DISCHARGE HEAD

CROSS REFERENCE TO RELATED APPLICATION

The present application claims priority from Japanese Patent Application No. 2019-141968 filed on Aug. 1, 2019, the disclosure of which is incorporated herein by reference in its entirety.

BACKGROUND

Field of the Invention

The present disclosure relates to a liquid discharge head configured to discharge liquid from nozzles.

Description of the Related Art

There is known a liquid discharge apparatus including nozzles, pressure chambers communicating with the nozzles, and a reservoir communicating with the pressure chambers via ink supply channels. In the liquid discharge apparatus, the reservoir and the ink supply channels are formed in a reservoir forming member, which is different from a channel substrate in which the pressure chambers are formed. Thus, it is not necessary to form the reservoir in the channel substrate, which downsizes the channel substrate.

SUMMARY

In the above liquid discharge apparatus, the reservoir forming member is joined to the channel substrate, so that the ink supply channels are connected to ink supply holes formed at ends in a longitudinal direction of the pressure chambers. However, in each pressure chamber, the width of the end having the ink supply hole is narrower than the width of a center portion facing a piezoelectric element. Thus, when the reservoir forming member is joined to the channel substrate, it is difficult to perform the position alignment (position adjustment) between the ink supply channels and the ink supply holes. If the positions of the ink supply channels are shifted from the positions of the ink supply holes, ink may leak and a short circuit may occur between traces formed around the ink supply holes.

An object of the present disclosure is to provide a liquid discharge head in which position alignment (position adjustment) between an ink supply channel and an ink supply hole is easily performed when a reservoir member is joined to a pressure chamber plate.

According to an aspect of the present disclosure, there is provided a liquid discharge head, including: a first substrate including a pressure chamber, the first substrate having a first surface in which a nozzle communicating with the pressure chamber is opened and a second surface positioned at an opposite side of the first surface and in which a communication hole communicating with the pressure chamber is opened; and a second substrate joined to the second surface of the first substrate and in which a channel communicating with the pressure chamber via the communication hole is formed, wherein the pressure chamber has a first end on one side in a first direction and a center portion in the first direction, the first direction being along the first surface, the communication hole communicates with the first end of the pressure chamber, and the first end of the pressure chamber is greater than the center portion of the pressure chamber in length in a second direction, which is along the first surface and intersects with the first direction.

In the liquid discharge head according to the aspect of the present disclosure, the channel formed in the second substrate communicates with the first end at the first side in the first direction of the pressure chamber via the communication hole. Here, the first end of the pressure chamber is greater than the center portion of the pressure chamber in length in the second direction. Thus, the position alignment between the channel and the communication hole is easy when the second substrate having the channel is joined to the first substrate having the pressure chamber.

DESCRIPTION OF THE EMBODIMENTS

Figure 1:
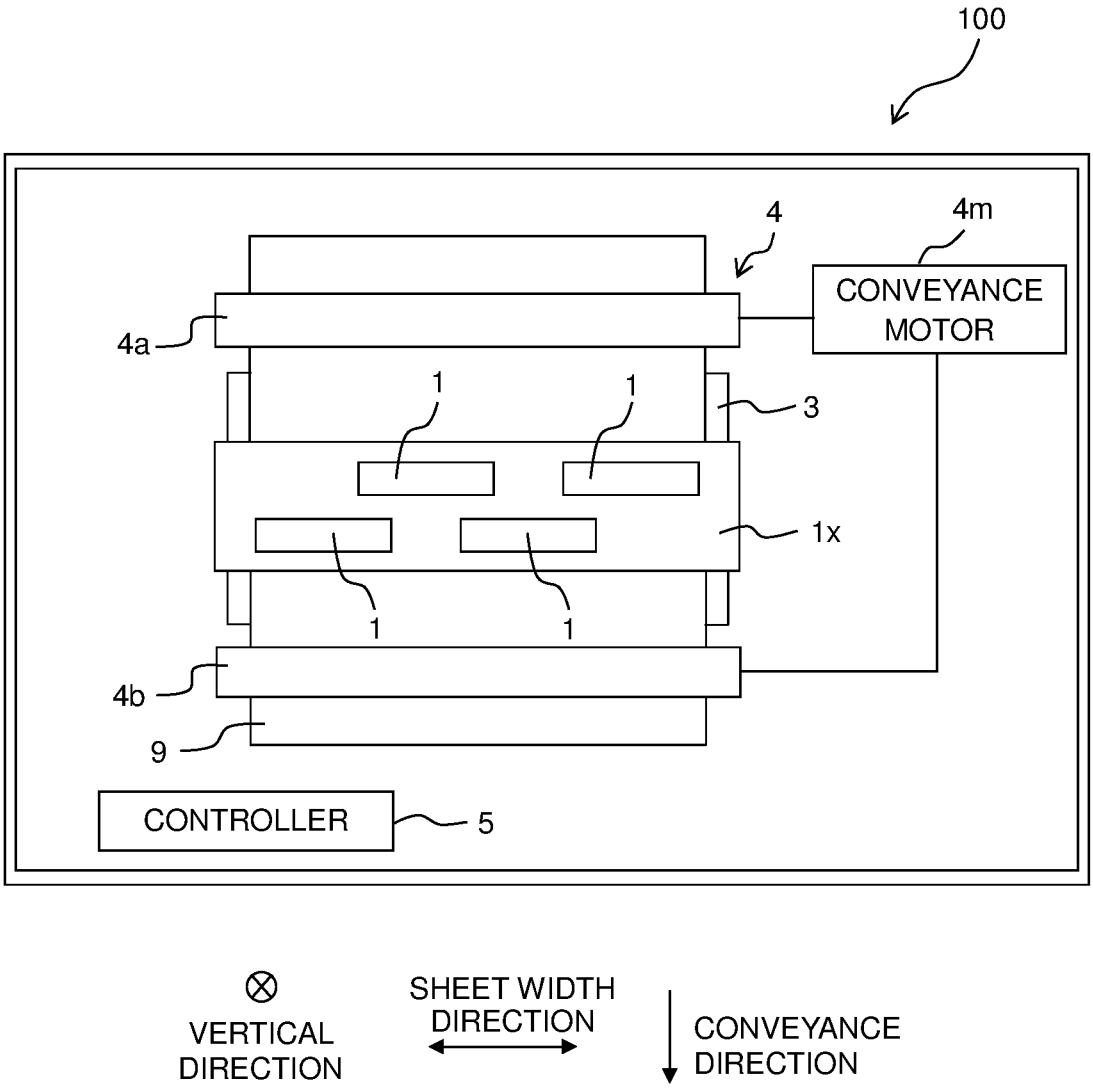
FIG. 1 is a plan view of a printer according to an embodiment of the present disclosure.

Referring to FIG. 1, a schematic configuration of a printer 100 with heads 1 according to an embodiment of the present disclosure is described below.

The printer 100 includes a head unit 1*x* including the four heads 1 (an exemplary liquid discharge head), a platen 3, a conveyer 4, and a controller 5.

A sheet 9 is placed on an upper surface of the platen 3.

The conveyer 4 includes two roller pairs 4*a* and 4*b*. When a conveyance motor 4*m* is driven by the control of the controller 5, the roller pairs 4*a* and 4*b* rotate with the sheet 9 nipped therebetween, and the sheet 9 is conveyed in a conveyance direction (an exemplary first direction). The two roller pairs 4*a* and 4*b* are arranged to sandwich the platen 3 in the conveyance direction.

The head unit 1*x* is a line-type head unit in which ink is discharged from nozzles 11*n* (see, FIGS. 2 and 4) onto the sheet 9 in a state where the head unit 1*x* is fixed to the printer. The head unit 1*x* is long in a sheet width direction (an exemplary second direction). The four heads 1 are arranged zigzag in the sheet width direction.

Here, the sheet width direction is orthogonal to the conveyance direction in this embodiment. Both the sheet width direction and the conveyance direction are orthogonal to a vertical direction.

The controller 5 includes a Read Only Memory (ROM), a Random Access Memory (RAM), and an Application Specific Integrated Circuit (ASIC). The ASIC executes a recording process and the like in accordance with programs stored in the ROM. In the recording process, the controller 5 controls a driver IC 19 (see FIG. 4) and a conveying motor (not depicted) of each head 1 based on a recording instruction (including image data) inputted from an external apparatus such as a personal computer, thus recording an image on the sheet P. Specifically, the controller 5 alternately performs a discharge operation and a conveyance operation. In the discharge operation, ink droplets are discharged from the nozzles 11*n*. In the conveyance operation, the sheet 9 is conveyed in the conveyance direction by a predefined amount by use of the roller pairs 4*a* and 4*b*.

Figure 2:
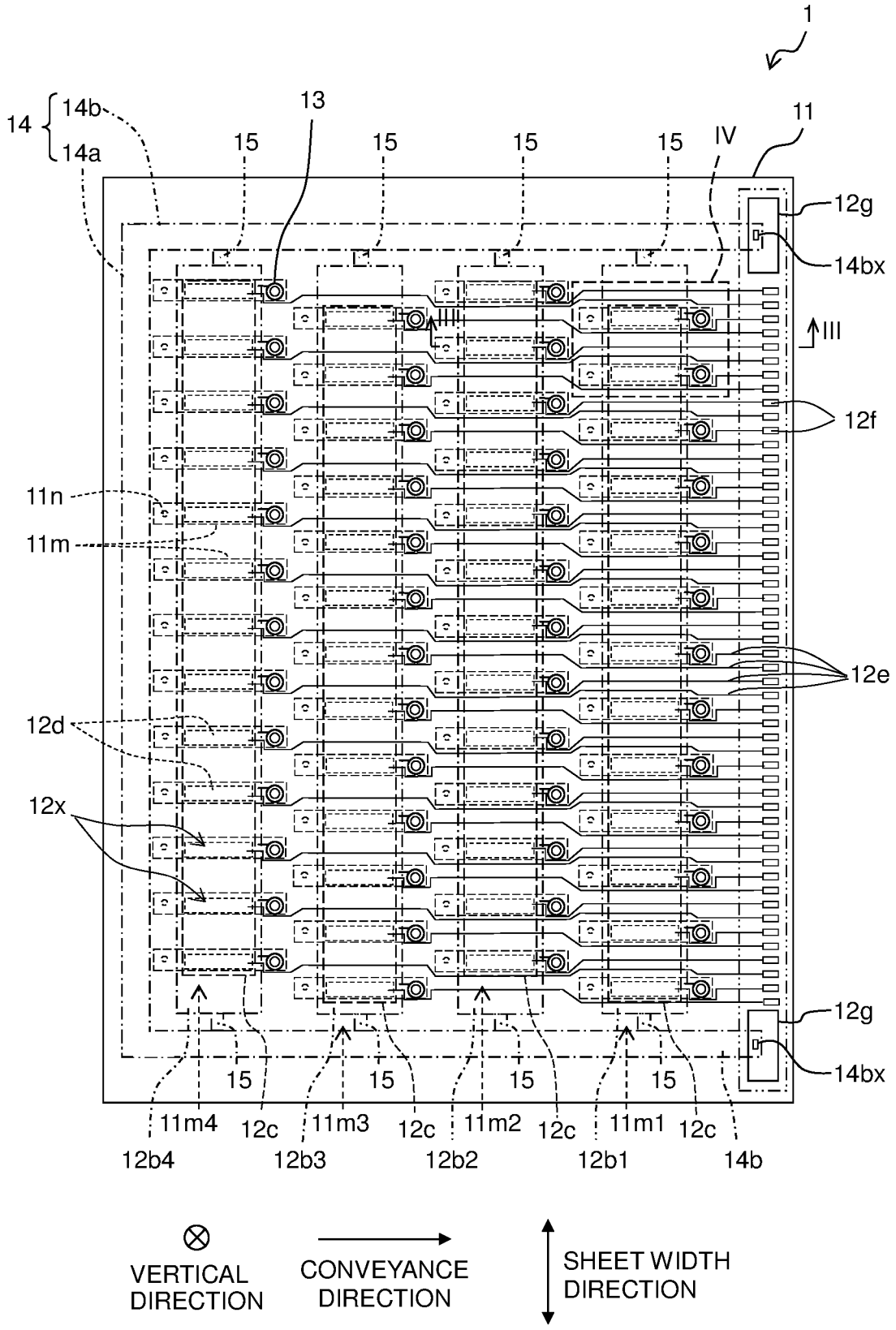
FIG. 2 is a plan view of a head in the printer.
Figure 3:
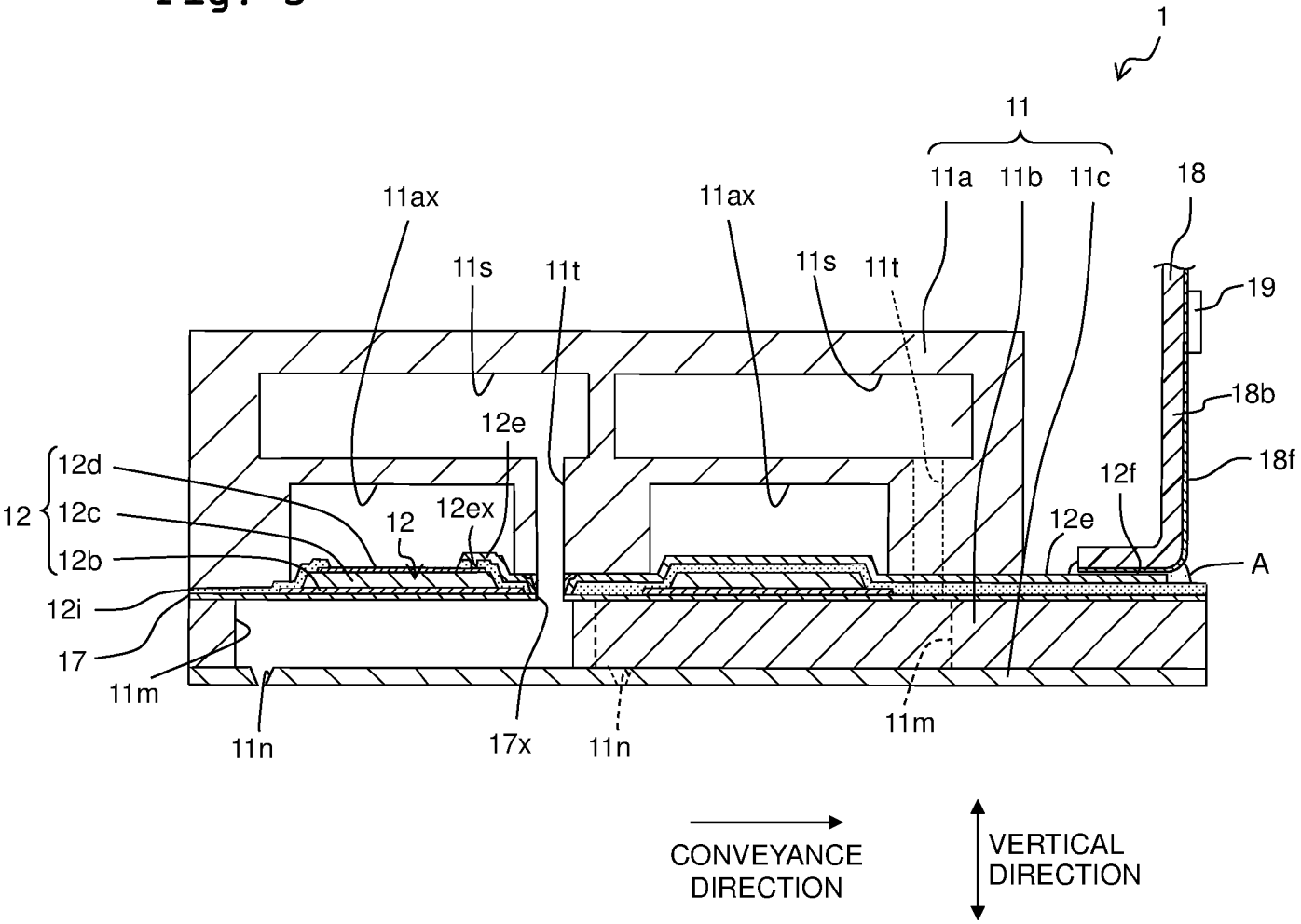
FIG. 3 is a cross-sectional view of the head taken along line III-III of FIG. 2.
Figure 4:
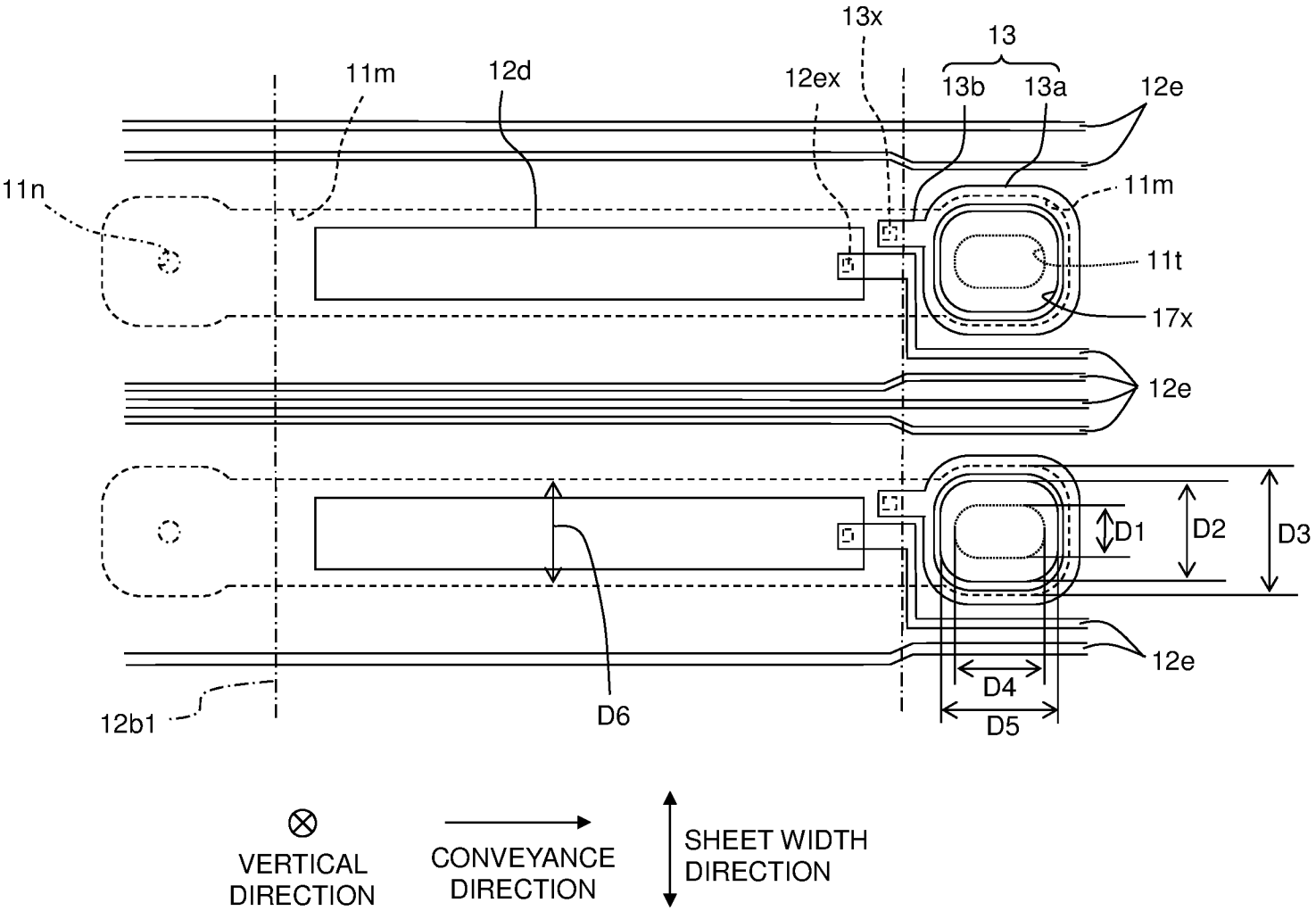
FIG. 4 is an enlarged view of an area IV depicted in FIG. 2.

Referring to FIGS. 2 to 4, a configuration of the heads 1 is described below.

As depicted in FIGS. 2 and 3, each head 1 includes a channel substrate 11, a piezoelectric actuator 12, and a COF 18.

As depicted in FIG. 3, the channel substrate 11 includes a reservoir member 11*a*, a pressure chamber plate 11*b*, and a nozzle plate 11*c*. In FIG. 2, illustration of the reservoir member 11*a* is omitted.

Pressure chambers 11*m* are formed in the pressure chamber plate 11*b*. The nozzle plate 11*c* is formed with the nozzles 11*n* that communicate with the respective pressure chambers 11*m*. Reservoirs 11*s* are formed in the reservoir member 11*a*. Each of the reservoirs 11*s* is common to the pressure chambers 11*m*. The reservoirs 11*s* communicate with a tank (not depicted) containing ink.

As depicted in FIG. 2, the pressure chambers 11*m* are arranged in the sheet width direction to form four pressure chamber rows 11*m*1 to 11*m*4 arranged in the conveyance direction. In each of the pressure chamber rows 11*m*1 to 11*m*4, the pressure chambers 11*m* are arranged at regular intervals in the sheet width direction. Of the four pressure chamber rows 11*m*1 to 11*m*4, the pressure chambers 11*m* belonging to the two pressure chamber rows 11*m*1 and 11*m*2 disposed on the right of FIG. 2 are arranged zigzag, so that positions in the sheet width direction of the pressure chambers 11*m* belonging to one of the two pressure chamber rows 11*m*1 and 11*m*2 are different from those belonging to the other. Of the four the pressure chamber rows 11*m*1 to 11*m*4, the pressure chambers 11*m* belonging to the two pressure chamber rows 11*m*3 and 11*m*4 disposed on the left of FIG. 2 are arranged zigzag, so that positions in the sheet width direction of the pressure chambers 11*m* belonging to one of the two pressure chamber rows 11*m*3 and 11*m*4 are different from those belonging to the other.

As depicted in FIG. 2, the nozzles 11*n* are arranged in the sheet width direction similarly to the pressure chambers 11*m*. The nozzles 11*n* form four nozzle rows arranged in the conveyance direction. In each nozzle row, the nozzles 11*n* are arranged in the sheet width direction at regular intervals. Of the four nozzle rows, the nozzles 11*n* belonging to the two nozzle rows disposed on the right of FIG. 2 are arranged zigzag, so that positions in the sheet width direction of the nozzles 11*n* belonging to one of the two right nozzle rows are different from those belonging to the other. Of the four nozzle rows, the nozzles 11*n* belonging to the two nozzle rows disposed on the left of FIG. 2 are arranged zigzag, so that positions in the sheet width direction of the nozzles 11*n* belonging to one of the two left nozzle rows are different from those belonging to the other. The respective nozzles 11*n* overlap in the vertical direction with ends at an upstream side in the conveyance direction (left side in FIG. 2) of the pressure chambers 11*m* corresponding thereto.

As depicted in FIG. 3, the nozzle plate 11*c* is adhered or bonded to a lower surface of the pressure chamber plate 11*b*. Namely, the nozzle plate 11*c* is disposed at a side opposite to the piezoelectric actuator 12 with respect to the pressure chamber plate 11*b*. A lower surface of the nozzle plate is an exemplary first surface of the present disclosure.

The reservoir member 11*a* is adhered or bonded to an upper surface of the pressure chamber plate 11*b* via the piezoelectric actuator 12.

Not only the reservoirs 11*s* but also supply channels lit are formed in the reservoir member 11*a*. The supply channels lit allow the respective reservoirs 11*s* to communicate with the pressure chambers 11*m*. Further, the reservoir member 11*a* is formed with four recesses 11*ax* extending in the sheet width direction. The four recesses 11*ax* are formed in a lower surface of the reservoir member 11*a* to face the respective pressure chamber rows 11*m*1 to 11*m*4 in the vertical direction. Each of the supply channels 11*t* is an exemplary channel of the present disclosure.

A vibration plate 17 is provided on the upper surface of the pressure chamber plate 11*b*. The pressure chamber plate 11*b* is formed by a silicon single crystal substrate, and the vibration plate 17 is, for example, an insulating layer formed by oxidizing or nitriding a surface of the pressure chamber plate 11*b*. The vibration plate 17 is disposed to cover a substantially entire portion of the upper surface of the pressure chamber plate 11*b*. The vibration plate 17 is positioned between the piezoelectric actuator 12 and the pressure chamber plate 11*b* to cover the pressure chambers 11*m*. An upper surface of the vibration plate 17 is an exemplary second surface of the present disclosure. A combination of the nozzle plate 11*c*, the pressure chamber plate 11*b*, and the vibration plate 17 is an exemplary first substrate of the present disclosure.

Portions of the vibration plate 17 facing the respective supply channels 11*t* in the vertical direction are formed with communication holes 17*x*. Driving a pump (not depicted) supplies ink from the tank to the reservoirs 11*s*. The supplied ink passes through the supply channels 11*t* and the communication holes 17*x* and then is supplied to the corresponding pressure chambers 11*m*.

As depicted in FIG. 3, the piezoelectric actuator 12 is disposed on the upper surface of the pressure chamber plate 11*b* via the vibration plate 17 to cover all the pressure chambers 11*m* formed in the pressure chamber plate 11*b*.

In the piezoelectric actuator 12, the common electrode 12*b*, four piezoelectric bodies 12*c*, and the individual electrodes 12*d* are stacked in this order from the bottom.

The common electrode 12*b* is disposed on the upper surface of the vibration plate 17.

As depicted in FIG. 2, the common electrode 12*b* includes four common electrodes 12*b*1 to 12*b*4 separated from each other in the conveyance direction. Each of the common electrodes 12*b*1 to 12*b*4 is common to the pressure chambers 11*m* belonging to one of the pressure chamber rows 11*m*1 to 11*m*4. Each of the common electrodes 12*b*1 to 12*b*4 faces the pressure chambers 11*m* belonging to one of the pressure chamber rows 11*m*1 to 11*m*4 in the vertical direction. The common electrodes 12*b*1 to 12*b*4 are made from, for example, platinum (Pt).

As depicted in FIG. 2, each of the four the piezoelectric bodies 12*c* extends in the sheet width direction on an upper surface of one of the common electrodes 12*b*1 to 12*b*4, covering all the pressure chambers 11*m* belonging to one of the pressure chamber rows 11*m*1 to 11*m*4. Each piezoelectric body 12*c* is made from, for example, lead zirconate titanate (PZT).

The individual electrodes 12*d* are disposed on upper surfaces of the piezoelectric bodies 12*c* to face the respective pressure chambers 11*m* in the vertical direction.

As depicted in FIG. 2, the individual electrodes 12*d* are arranged in the sheet width direction similarly to the pressure chambers 11*m*. The individual electrodes 12*d* form four individual electrode rows arranged in the conveyance direction. The individual electrodes 12*d* belonging to each of the individual electrode rows face one of the common electrodes 12*b*1 to 12*b*4 in the vertical direction. In each individual electrode row, the individual electrodes 12*d* are arranged in the sheet width direction at intervals. The individual electrodes 12*d* belonging to the two individual electrode rows disposed on the right of FIG. 2 among the four individual electrode rows are arranged zigzag so that positions in the sheet width direction of the individual electrodes 12*d* belonging to one of the two individual electrode rows are different from those belonging to the other. The individual electrodes 12*d* belonging to the two individual electrode rows disposed on the left of FIG. 2 among the four individual electrode rows are arranged zigzag so that positions in the sheet width direction of the individual electrodes 12*d* belonging to one of the two individual electrode rows are different from those belonging to the other.

The individual electrode 12*d*, the common electrode 12*b*, and a portion (hereinafter referred to as an active portion) of the piezoelectric body 12*c* sandwiched between the individual electrode 12*d* and the common electrode 12*b* function as a piezoelectric element 12*x* that is deformable in response to the application of voltage to the individual electrode 12*d*. Namely, the piezoelectric actuator 12 is formed by piezoelectric elements 12*x* facing the respective pressure chambers 11*m*. When the piezoelectric element 12*x* is driven (e.g., the piezoelectric body 12*c* is deformed to be convex toward the pressure chamber 11*m*) in response to the application of the voltage to the individual electrode 12*d*, the volume of the piezoelectric body 12*c* is changed to apply pressure to the ink in the pressure chamber 11*m*. This discharges ink from the nozzle 11*n*.

Further, the piezoelectric actuator 12 has individual traces 12*e*, individual contacts 12*f*, two common contacts 12*g*, annular traces 13, a common trace 14 and coupling traces 15. The traces 12*e*, 13 to 15 and the contacts 12*f* and 12*g* are made from the same material (e.g., aluminium (Al)).

The individual traces 12*e* are provided for the respective individual electrodes 12*d*. The individual traces 12*e* connect the individual electrodes 12*d* and the individual contacts 12*f* corresponding thereto. Each annular trace 13 is connected to any of the common electrodes 12*b*1 to 12*b*4. The common electrodes 12*b*1 to 12*b*4 are connected to the common trace 14 via the coupling traces 15. Further, the common trace 14 is connected to two common contacts 12*g*.

As depicted in FIG. 3, the individual contacts 12*f* are disposed in an area of the pressure chamber plate 11*b* not covered with the reservoir member 11*a*. Similarly, the two common contacts 12*g* are disposed in the area of the pressure chamber plate 11*b* not covered with the reservoir member 11*a*.

The individual contacts 12*f* and two common contacts 12*g* are arranged in a row in the sheet width direction at a downstream side in the conveyance direction (right side in FIG. 2) with respect to a group formed by all the individual electrodes 12*d* provided in the piezoelectric actuator 12. The individual contacts 12*f* are arranged in the sheet width direction at intervals. The two common contact points 12*g* sandwich the individual contacts 12*f* in the sheet width direction.

The common trace 14 includes a facing portion 14*a* and two connecting portions 14*b*. The facing portion 14*a* is provided on the upstream side in the conveyance direction (left side in FIG. 2) with respect to the group formed by all the individual electrodes 12*d* provided in the piezoelectric actuator 12. The two connecting portions 14*b* extend from both sides in the sheet width direction of the facing portion 14*a* (in this embodiment, both ends in the sheet width direction of the facing portion 14*a*) toward the downstream side in the conveyance direction (right side in FIG. 2). The two connecting portions 14*b* are connected to the two respective common contacts 12*g*. The facing portion 14*a* is integrally formed with the two connecting portions 14*b*. The group of individual electrodes 12*d* is surrounded by the common trace 14 and the row of the individual contacts 12*f*.

The facing portion 14*a* has a rectangular shape that is long in the sheet width direction. Each connecting portion 14*b* has a rectangular shape that is long in the conveyance direction. An end at the upstream side in the conveyance direction (left side in FIG. 2) of each connecting portion 14*b* is connected to the facing portion 14*a*. An end at the downstream side in the conveyance direction (right side in FIG. 2) of each connecting portion 14*b* is electrically connected to each common contact 12*g* via a portion (contact portion 14*bx*) that enters into a through hole of an insulating film 12*i* described below. Each connecting portion 14*b* is connected to the common electrodes 12*b*1 to 12*b*4 through the connecting traces 15.

The common trace 14 and the coupling traces 15 are larger in width than the traces 12*e* and 13. The traces 12*e* and 13-15 have the substantially same thickness.

The individual traces 12*e* extend in the conveyance direction. An end at the upstream side in the conveyance direction (left side in FIG. 2) of each individual trace 12*e* has a contact portion 12*ex* (see FIG. 3) with the corresponding individual electrode 12*d*. An end at the second side in the conveyance direction (right side in FIG. 2) of each individual trace 12*e* has an individual contact 12*f*.

The individual traces 12*e* that are connected to individual electrodes 12*d* (included in the individual electrodes 12*d* forming the individual electrode row at the most upstream side in the conveyance direction, and except for the individual electrodes 12*d* positioned at the both ends in the sheet width direction) extend in the conveyance direction and pass through between the two individual electrodes 12*d* adjacent to each other in the sheet width direction in the second, third, and fourth individual electrode rows from the upstream side in the conveyance direction. The individual traces 12*e* that are connected to individual electrodes 12*d* (included in the individual electrodes 12*d* forming the second individual electrode row from the upstream side in the conveyance direction, and except for the individual electrode 12*d* positioned at one side in the sheet width direction (lower side in FIG. 2)) extend in the conveyance direction and pass through between the two individual electrodes 12*d* adjacent to each other in the sheet width direction in the third and fourth individual electrode rows from the upstream side in the conveyance direction. The individual traces 12*e* that are connected to individual electrodes 12*d* (included in the individual electrodes 12*d* forming the third individual electrode row from the upstream side in the conveyance direction, and except for the individual electrode 12*d* positioned at another side in the sheet width direction (upper side in FIG. 2)) extend in the conveyance direction and pass through between the two individual electrodes 12*d* adjacent to each other in the sheet width direction in the fourth individual electrode row from the upstream side in the conveyance direction.

As depicted in FIGS. 2 and 4, each annular trace 13 has an annular portion 13*a* and an extending portion 13*b* that extends in the conveyance direction from the annular portion 13*a*. Each annular portion 13*a* surrounds the communication hole 17*x*. Each extending portion 13*b* has a first end connected to the annular portion 13*a* and a second end connected to the common electrode 12*b*. In this embodiment, each annular trace 13 is arranged so as not to overlap with a separation wall, which is provided between any two pressure chambers 11*m* adjacent to each other in the sheet width direction.

In this embodiment, the insulating film 12*i* (not depicted in FIG. 2; see FIG. 3) is provided to improve the insulating property between each individual trace 12*e* and the common electrode 12*b*. The insulating film 12*i* is disposed over the substantially entire upper surface of the vibration plate 17, and covers the common electrodes 12*b*1 to 12*b*4, the piezoelectric bodies 12*c*, the common trace 14, and the coupling traces 15. However, the insulating film 12*i* covers only outer edges of the respective individual electrodes 12*d* so as not to inhibit the driving of the piezoelectric elements 12*x*, and the center portions of the respective individual electrodes 12*d* are exposed from the insulating film 12*i*. The insulating film 12*i* is made from, for example, silicone dioxide ($SiO_2$).

The individual traces 12*e*, the annular traces 13, the individual contacts 12*f*, and the two common contacts 12*g* are disposed on an upper surface of the insulating film 12*i*.

Similar to the common electrode 12*b*, the common trace 14 and the coupling traces 15 are arranged on the upper surface of the vibration plate 17 at a lower side of the insulating film 12*i*.

Each of the individual traces 12*e* is electrically connected to the corresponding one of the individual electrodes 12*d* through a portion (contact portion 12*ex*) that enters into the through hole of the insulating film 12*i*. The extending portion 13*b* of each annular trace 13 is electrically connected to any of the common electrodes 12*b*1 to 12*b*4 via a portion (contact portion 13*x*) that enters into the through hole of the insulating film 12*i*.

Each contact portion 12*ex* is provided at an end on the downstream side in the conveyance direction (right side in FIGS. 2 to 4) of the corresponding one of individual electrodes 12*d*. Each contact portion 13*x* is provided at an end on the downstream side in the conveyance direction (right side in FIG. 2) of each of the common electrodes 12*b*1 to 12*b*4.

As depicted in FIG. 3, the COF 18 has an insulating sheet 18*b* made from polyimide or the like, individual traces 18*f* electrically connected to the respective individual contacts 12*f*, and two common traces (not depicted) electrically connected to the respective common contacts 12*g*.

A first end of the COF 18 is adhered or bonded to the channel substrate 11 via an adhesive A with the individual traces 18*f* and the common traces facing the individual contacts 12*f* and the common contacts 12*g*, respectively. The second end of the COF 18 is electrically connected to the controller 5 (see FIG. 1).

The driver IC 19 is mounted between the first end and the second end of the COF 18. The driver IC 19 generates a driving signal to drive the piezoelectric element 12*x* based on a signal from the controller 5, and provides the driving signal to the individual electrode 12*d*. The electric potential of the common electrode 12*b* is maintained at a ground potential. When the driving signal is supplied to the individual electrode 12*d*, the electric potential of the individual electrode 12*d* varies between a predetermined driving potential and the ground potential.

When the electric potential of the individual electrode 12*d* changes from the ground potential to the driving potential, a potential difference is caused between the individual electrode 12*d* and the common electrode 12*b*. This causes an electric field parallel to a thickness direction of the piezoelectric body 12*c* to act on the active portion of the piezoelectric body 12*c*. At this time, since the polarization direction of the active portion of the piezoelectric body 12*c* (the thickness direction of the piezoelectric body 12*c*) is the same as the direction of the electric field, the active portion extends in the thickness direction of the piezoelectric body 12*c* and contracts in a planar direction of the piezoelectric body 12*c*. The contraction deformation of the active portion of the piezoelectric body 12*c* deforms the vibration plate 17 and a portion of the piezoelectric actuator 12 facing the pressure chamber 11*m* so that the portion becomes convex toward the pressure chamber 11*m*. This deformation reduces the volume of the pressure chamber 11*m*, applying the energy to the ink in the pressure chamber 11*m* and discharging ink droplets from the nozzle 11*n* communicating with the pressure chamber 11*m*.

As depicted in FIGS. 2 and 4, each pressure chamber 11*m* has a substantially rectangular planar shape that is long in the conveyance direction. Then, as depicted in FIG. 4, both ends in the conveyance direction of each pressure chamber 11*m* has a length D3 in the sheet width direction that is, for example, approximately 3 to 4 μm longer than a length D6 in the sheet width direction of a center portion in the conveyance direction of each pressure chamber 11*m*. This makes a length D2 in the sheet width direction of the communication hole 17*x* long, making it possible to easily perform the position alignment between the supply channels 11*t* and the communication holes 17*x* when the reservoir member 11*a* is joined to the pressure chamber plate 11*b*. Further, a length in the sheet width direction of a center portion in the conveyance direction of the separation wall between two pressure chambers 11*m* adjacent to each other in the sheet width direction can be longer than a length in the sheet width direction of both ends in the conveyance direction of the separation wall. This inhibits the crosstalk between the two pressure chambers 11*m* adjacent to each other in the sheet width direction.

As depicted in FIG. 4, since the individual traces 12*e* are arranged between the two communication holes 17*x* adjacent to each other in the sheet width direction, the accuracy of position alignment in the sheet width direction between the supply channels 11*t* and the communication holes 17*x* is required to be higher than that in the conveyance direction. In this regard, in this embodiment, as depicted in FIG. 4, a length D5 in the conveyance direction of the communication hole 17*x* is longer than the length D2 in the sheet width direction of the communication hole 17*x*. A length D4 in the conveyance direction of a cross section parallel to a horizontal plane of the supply channel 11*t* is longer than the length D1 in the sheet width direction. This makes the accuracy of the position alignment between the supply channels 11*t* and the communication holes 17*x* in the sheet width direction higher than that in the conveyance direction. Further, it is possible to inhibit the decrease in channel resistance by making the lengths in the sheet width direction of the communication hole 17*x* and the cross section parallel to the horizontal plane of the supply channel 11*t* short and making the length in the conveyance direction of the communication hole 17*x* and the cross section parallel to the horizontal plane of the supply channel 11*t* long.

As depicted in FIG. 4, the length D3 in the sheet width direction of an end at the downstream side in the conveyance direction (right side in FIG. 4) of the pressure chamber 11*m* is longer than the length D2 in the sheet width direction of the communication hole 17*x*. The length D2 in the sheet width direction of the communication hole 17*x* is longer than the length D1 in the sheet width direction of the cross section parallel to the horizontal direction of the supply channel 11*t*. Therefore, it is easy to perform the position alignment when the communication hole 17*x* is formed at the end at the downstream side in the conveyance direction of each pressure chamber 11*m*. Further, when the reservoir member 11*a* is joined to the pressure chamber plate 11*b*, it is possible to easily perform the position alignment between the supply channels 11*t* and the communication holes 17*x*.

Further, as depicted in FIG. 4, the difference between the length D2 in the sheet width direction of the communication hole 17*x* and the length D1 in the sheet width direction of the cross-section parallel to the horizontal direction of the supply channel 11*t* is greater than the difference between the length D3 in the sheet width direction of the end at the downstream side in the conveyance direction (right side in FIG. 4) of the pressure chamber 11*m* and the length D2 in the sheet width direction of the communication hole 17*x*. Therefore, a shift amount (deviation amount) in the sheet width direction when the reservoir member 11*a* is joined to the pressure chamber plate 11*b* is allowed to be larger than an shift amount in the sheet width direction of a mask used when the communication holes 17*x* are formed at the ends of the respective pressure chambers 11*m*.

The annular traces 13 surrounding the respective communication holes 17*x* are formed on the upper surface of the insulating film 12*i*. Forming the annular traces 13 makes the periphery of the communication holes 17*x* higher than the upper surface of the insulating film 12*i*. Thus, even when ink flows out of a joining portion between the supply channel 11*t* and the communication hole 17*x* due to, for example, joining failure between the reservoir 11*a* and the pressure chamber plate 11*b*, the ink is blocked by the annular trace 13. As a result, the ink flowing out of the joining portion between the supply channel 11*t* and the pressure chamber 11*m* is not likely to reach the piezoelectric actuator 12.

Further, as depicted in FIG. 4, at least part of each annular trace 13 extends outward beyond the end at the downstream side in the conveyance direction (right side in FIG. 4) of the pressure chamber 11*m*, when viewed from above. In other words, at least part of each annular trace 13 overlaps with a part of the pressure chamber plate 11*b* where the pressure chamber 11*m* is not formed, when viewed from above. Therefore, when the reservoir member 11*a* is pressed against and joined to the pressure chamber plate 11*b*, it is possible to reduce the possibility that the vibration plate 17 is damaged.

Further, as depicted in FIG. 3, part of the reservoir member 11*a* in which the recess flax and the supply channel 11*t* are not formed is joined to the periphery of the communication hole 17*x* in the upper surface of the vibration plate 17. Namely, the end in the conveyance direction of each pressure chamber 11*m* is constrained or held by the reservoir member 11*a*. This inhibits the crosstalk between the two pressure chambers 11*m* adjacent to each other in the sheet width direction.

Figure 5:
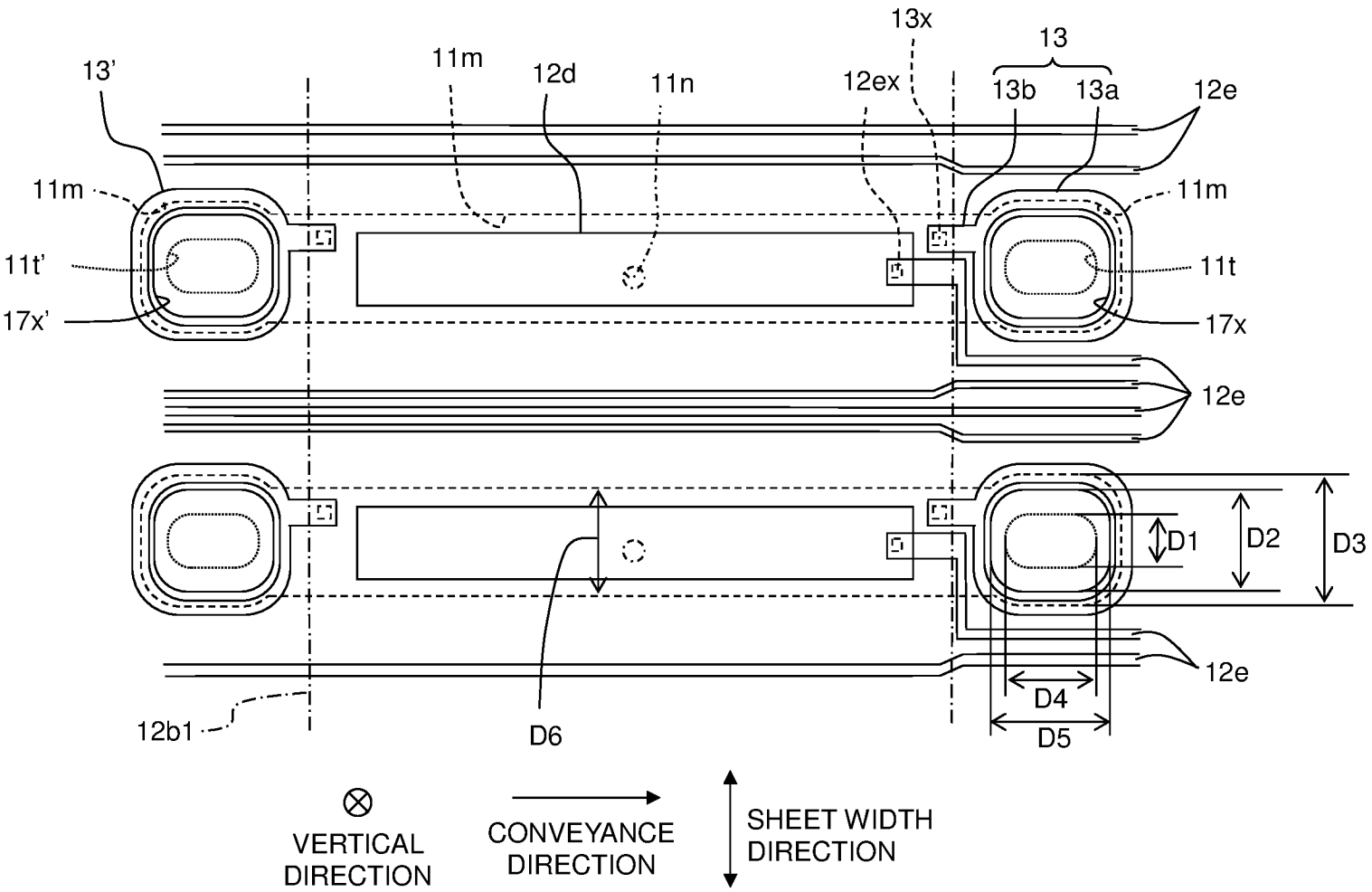
FIG. 5 is an enlarged view of the head according to a modified example of the present disclosure, which corresponds to FIG. 4.

In the above embodiment, only the supply channels 11*t* for supplying the ink in the reservoir 11*s* to the pressure chambers 11*m* are formed in the reservoir member 11*a*. The present disclosure, however, is not limited thereto. For example, a recovery reservoir and return channels 11*t*' for returning the ink in the pressure chambers 11*m* to the recovery reservoir may be further formed, and ink may circulate between the reservoir 11*s* and the pressure chambers 11*m* and the recovery reservoir. In this case, as depicted in FIG. 5, the supply channels 11*t* may communicate with the ends at the downstream side in the conveyance direction (right side in FIG. 5) of the pressure chambers 11*m* via the communication holes 17*x* similarly to the above embodiment. On the other hand, the return channels 11*t*' may communicate with the ends at the upstream side in the conveyance direction (left side in FIG. 5) of the pressure chambers 11*m* via communication holes 17*x*'. Further, annular traces 13' may be formed to surround the periphery of the communication holes 17*x*'. Further, the nozzles 11*n* may be arranged to overlap with the center portions in the conveyance direction of the pressure chambers.

Figure 6:
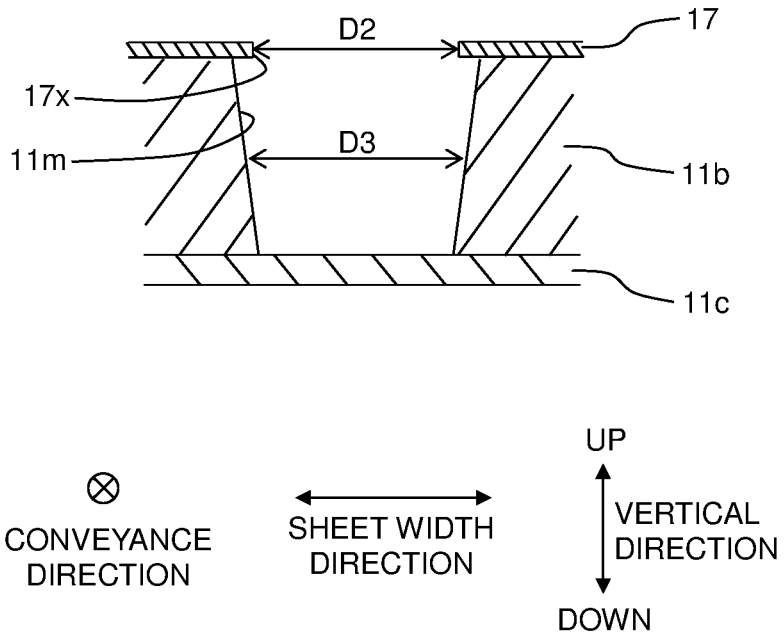
FIG. 6 is a cross-sectional view of an end of a pressure chamber according to the modified example of the present disclosure when seen from a conveyance direction.

In the above embodiment, the length D3 in the sheet width direction of the end in the conveyance direction of each pressure chamber 11*m* is constant with respect to the vertical direction. The present disclosure, however, is not limited thereto. For example, as depicted in FIG. 6, the length D3 in the sheet width direction of the end in the conveyance direction of each pressure chamber 11*m* may increase upwardly. This makes the length D2 in the sheet width direction width of the communication hole 17*x* larger, making it possible to easily perform the position alignment between the supply channels 11*t* and the communication holes 17*x* when the reservoir member 11*a* is joined to the pressure chamber plate 11*b*.

In the above embodiment, the communication holes 17*x* are surrounded by the metallic annular traces 13. The present disclosure, however, is not limited thereto. The communication holes 17*x* may be surrounded by, for example, annular members made from resin.

In the above embodiment and the modified examples, the printer 100 performs printing on the recording sheet 9 by a line head system in which ink is discharged from the head unit 1*x* that is fixed to the printer 100 and is long in the sheet width direction. The printer 100, however, may perform printing on the recording sheet 9 by a serial head system in which the carriage moves the ink-jet head in the sheet width direction.

In the embodiment and the modified examples, the examples in which the present disclosure is applied to the ink-jet head that discharges ink from nozzles, are explained. The present disclosure, however, is not limited thereto. The present disclosure is applicable to a liquid discharge apparatus that is different from the ink-jet head and is configured to discharge any other liquid than ink from nozzles.

What is claimed is:

1. A liquid discharge head, comprising:

a first substrate including a pressure chamber, the first substrate having a first surface in which a nozzle communicating with the pressure chamber is opened and a second surface positioned at an opposite side of the first surface and in which a communication hole communicating with the pressure chamber is opened; and a second substrate joined to the second surface of the first substrate and in which a channel communicating with the pressure chamber via the communication hole is formed, wherein the pressure chamber has:

a first end on one side in a first direction, a center portion in the first direction, the first direction being along the first surface, and a second end on another side in the first direction, wherein the nozzle communicates with the second end of the pressure chamber, the communication hole communicates with the first end of the pressure chamber, and the first end of the pressure chamber is greater than the center portion of the pressure chamber in length in a second direction, which is along the first surface and intersects with the first direction.

2. The liquid discharge head according to claim 1, wherein the communication hole has a length in the first direction which is longer than a length in the second direction.

3. The liquid discharge head according to claim 1, wherein the channel has a cross section parallel to the first surface, and the cross section has a length in the first direction which is longer than a length in the second direction.

4. The liquid discharge head according to claim 1, wherein the second surface of the first substrate is formed with an annular trace surrounding the communication hole.

5. The liquid discharge head according to claim 4, wherein at least part of the annular trace overlaps with part of the first substrate in which the pressure chamber is not formed, when seen from a direction perpendicular to the first surface.

6. The liquid discharge head according to claim 1, further comprising a piezoelectric element disposed on the second surface of the first substrate and configured to apply discharge energy to liquid in the pressure chamber, wherein the second substrate has a third surface that faces the second surface of the first substrate, the third surface has a recess covering the piezoelectric element, and part of the third surface of the second substrate in which the recess is not formed is joined to a circumference of the communication hole in the second surface of the first substrate.

7. The liquid discharge head according to claim 1, wherein the second end of the pressure chamber is greater than the center portion of the pressure chamber in length in the second direction.

8. The liquid discharge head according to claim 1, wherein the length in the second direction of the first end of the pressure chamber increases in a direction from the first surface toward the second surface.

9. The liquid discharge head according to claim 1, wherein the channel has a cross section parallel to the first surface, the communication hole is greater than the cross section of the channel in length in the second direction, and the first end of the pressure chamber is greater than the communication hole in length in the second direction.

10. The liquid discharge head according to claim 9, wherein a difference between the length in the second direction of the communication hole and the length in the second direction of the cross section of the channel is greater than a difference between the length in the second direction of the first end of the pressure chamber and the length in the second direction of the communication hole.

11. A liquid discharge head, comprising:

a first substrate including a pressure chamber, the first substrate having a first surface in which a nozzle communicating with the pressure chamber is opened and a second surface positioned at an opposite side of the first surface and in which a communication hole communicating with the pressure chamber is opened, wherein the second surface of the first substrate is formed with an annular trace surrounding the communication hole, wherein at least part of the annular trace overlaps with part of the first substrate in which the pressure chamber is not formed, when seen from a direction perpendicular to the first surface; and a second substrate joined to the second surface of the first substrate and in which a channel communicating with the pressure chamber via the communication hole is formed, wherein the pressure chamber has a first end on one side in a first direction and a center portion in the first direction, the first direction being along the first surface, the communication hole communicates with the first end of the pressure chamber, and the first end of the pressure chamber is greater than the center portion of the pressure chamber in length in a second direction, which is along the first surface and intersects with the first direction.

* * * * *